US005212389A

United States Patent [19]

Wirtz

[11] Patent Number: 5,212,389

[45] Date of Patent: May 18, 1993

[54] APPARATUS FOR RECOGNIZING RESIDUAL YARN REMAINING ON TEXTILE BOBBINS AFTER UNWINDING UTILIZING A SENSING DEVICE COMPRISING A PHOTOOPTIC DETECTOR WITH A RECEIVER LENS

[75] Inventor: Ulrich Wirtz, Monchen-Gladbach, Fed. Rep. of Germany

[73] Assignee: W. Schlafhorst AG & Co., Monchen-Gladbach, Fed. Rep. of Germany

[21] Appl. No.: 863,423

[22] Filed: Apr. 3, 1992

[30] Foreign Application Priority Data

Apr. 3, 1991 [DE] Fed. Rep. of Germany ..... 4110729

[51] Int. Cl.[5] ..... G01N 21/86

[52] U.S. Cl. ..... 250/561; 250/223 R; 209/586; 139/273 A

[58] Field of Search ..... 250/561, 223 R, 222.1; 209/586; 356/379, 429; 139/273 A

[56] References Cited

U.S. PATENT DOCUMENTS

| | | | |
|---|---|---|---|
| 3,777,168 | 12/1973 | Sansone | 250/561 |
| 4,188,545 | 12/1980 | McClean et al. | 250/561 |
| 4,913,366 | 4/1990 | Andon | 250/561 |
| 5,118,958 | 6/1992 | Noshi et al. | 250/561 |
| 5,142,159 | 8/1992 | Veit et al. | 250/223 R |

*Primary Examiner*—David C. Nelms
*Assistant Examiner*—S. Allen
*Attorney, Agent, or Firm*—Shefte, Pinckney & Sawyer

[57] ABSTRACT

The presence of residual yarn on textile bobbins is recognized by a device capable of optically sensing and distinguishing yarn from a supporting bobbin or tube, which device is movable lengthwise along the bobbin or tube to perform a sensing operation. The sensing device includes a light source, a transmitter lens for focusing the light rays onto the surface of the bobbin, and a photooptic detector having a receiver lens for receiving the light rays reflected off the bobbin surface. The transmitter and receiver lenses have respective optical axes which, during sensing movement, are oriented to intersect one another at the bobbin surface, are oriented relative to the bobbin such that a line bisecting the axes deviates from a line intersecting the vertex of the axes perpendicular to the bobbin surface by at least ten degrees (10°), and also lie in a common plane oriented at an angle of at least about ninety degrees (90°) relative to the path of movement of the sensing device. Such orientation and arrangement of the transmitter and receiver lenses avoids direct reflection of transmitted light rays into the receiver lens, which minimizes any influence on the sensing operation by structural differences along the length of the bobbin.

13 Claims, 6 Drawing Sheets

APPARATUS FOR RECOGNIZING RESIDUAL YARN REMAINING ON TEXTILE BOBBINS AFTER UNWINDING UTILIZING A SENSING DEVICE COMPRISING A PHOTOOPTIC DETECTOR WITH A RECEIVER LENS

BACKGROUND OF THE INVENTION

The present invention relates generally to textile yarn winding apparatus and devices and, more particularly, to devices and apparatus by which residual yarn remaining on textile supply bobbins after unwinding may be detected.

In a normal winding operation, yarn supply bobbins are unwound in the winding heads of a bobbin winding machine until completely empty, that is, they leave the winding heads as empty tubes. It can occur, however, that a more or less large winding remnant of residual yarn may remain on a supply bobbin, whose starting end can no longer be supplied inside the winding head to the appropriate yarn guiding members or to a yarn joining device. Empty supply tubes, tubes with a slight residual yarn remnant and tubes with a fairly large, reusable winding of residual yarn ejected from the winding heads are removed jointly onto a common bobbin return path. Since these bobbins must be treated differently, it is necessary to use detectors on the common return path which can recognize and distinguish these different spent bobbins and control their segregation into different transport paths.

The detection and control of segregating spent winding supply bobbins preferably takes place in accordance with the current state of the art mechanically or photooptically. In many instances, however, photooptic sensors are preferred since they are subject to practically no wear, in contrast to mechanical sensors.

German Patent DE-AS 12 78 308 teaches a device in which, initially, bobbins with a fairly large reusable winding remnant and, then subsequently, bobbins with a smaller winding remnant which can no longer be processed are separated from the common return belt, while completely empty tubes are returned directly to the spinning machine. This initial segregation of bobbins with yarn remnants is accomplished at a first branch in the return path via the deflection of a mechanical feeler. A photooptic detector is located further downstream in the return path at a second branch which detector is capable of determining slight remaining yarn remnants. The detector utilizes a radiation source and a photodetector which are selectively arranged in such a manner that the bisecting line between their optical axes coincides with a line which is perpendicular to the surface of the textile bobbin tube and which intersects the vertex of the two optical axes. As a result thereof, the greatest part of the rays impinging upon the surface of the bobbin tube are reflected directly into the receiver lens of the photosensor. In addition, the two optical axes are arranged in a plane which also coincides with the center line of the bobbin tube.

A similar device is known from German Patent DE 40 08 795 A1, which exhibits the same features but in which relative motion between the detector and the bobbin required for detecting the yarn remnant is generated by the movement of the detector along the bobbin.

Disadvantageously, the known devices above-described do not always function with the desired reliability.

SUMMARY OF THE INVENTION

It is therefore an object of the present invention to provide an improved residual yarn detecting apparatus which functions reliably and otherwise overcomes the deficiencies of the state of the art.

Briefly summarized, the residual yarn detecting apparatus of the present invention basically comprises a device for optically sensing yarn on a textile bobbin and a suitable arrangement for moving either the sensing device or the textile bobbin relative to the other longitudinally with respect to the axis of the textile bobbin to scan the surface of the textile bobbin for residual yarn. The sensing device comprises a light transmitter for generating a limited beam of light rays, a transmitter lens for focusing the light rays onto the surface of the textile bobbin, and a photooptic detector having a receiver lens for receiving the light rays reflected off the surface of the textile bobbin. The transmitter lens and the receiver lens have respective optical axes which, in accordance with the present invention, are oriented relative to one another and relative to the textile bobbin such that, during relative movement between the sensing device and the textile bobbin: (a) the optical axes intersect one another in the area of the surface of the textile bobbin, (b) the optical axes are oriented relative to the textile bobbin such that a line bisecting the optical axes deviates from a line which is perpendicular to the surface of the bobbin and which intersects the point of intersection of the optical axes by an angle of deviation of at least about ten degrees (10°), and (c) the optical axes lie in a common plane oriented at an angle of at least about 90° relative to a line representing the path of relative movement of the focused light rays from the transmitter lens longitudinally along the surface of the textile bobbin.

The present invention is founded upon the recognition that differences in the luster or sheen of the surface of a textile bobbin may produce considerable differences in the intensity of reflected light rays received by a photosensor in photooptic residual yarn detecting apparatus. It is possible that such variations in reflected light can be so great that a photooptic detector may not be capable of reliably distinguishing between light rays reflected by the surface of the bobbin and light rays reflected by a residual yarn thereon. In addition, some conventional textile bobbins are provided with peripheral grooves, especially in the case of tubes used for cop-winding of yarn, which grooves can prevent light rays from being reflected directly into a receiver lens, which can also result in variations in reflected light making more difficult optical detection of a distinction between residual yarn and the yarn bobbin itself.

The geometrical arrangement of the transmitter lens and the receiver lens relative to one another and relative to the textile bobbin in accordance with the present invention assures that the light rays from the transmitter lens are not reflected directly into the receiver lens but, rather, only scattered light from the textile bobbin or residual yarn thereon is received by the receiver lens and thereby directed onto the photooptic detector. As a result, variations in the angle of reflection of the light only minimally affect the operation of the sensing device. Peripheral grooves in the textile bobbin likewise have little or no influence on the precision and reliability of the present apparatus since these grooves cause the angle of light reflection to change primarily or only in the plane of the lengthwise axis of the bobbin so as to have little or no appreciable influence on the photooptic sensing performed by the present invention. With textile bobbins having a helical groove in their peripheries, the sensing device of the present invention may be advantageously arranged so that the respective optical axes of the transmitter and receiver lenses lie in a common plane which is oriented at an angle to the line of relative movement of the focused light rays along the textile bobbin substantially equal to 90° plus the angular degree of inclination of the helical groove.

Essentially, the present invention thus excludes or avoids the occurrence of relatively significant fluctuations in the amount of light rays reaching the photooptic detector associated with the receiver lenses during performance of a yarn sensing operation on a textile bobbin which, advantageously, enables the presence of even the slightest amounts of residual yarn on the bobbin to be reliably detected.

In the preferred embodiment, the angle between the optical axes of the transmitter and receiver lenses is greater than the sum of the maximum focal angle of the transmitter lens measured between its optical axis and the path of focused light rays passing through its outermost edge and the maximum focal angle of the receiver lens measured between its optical axis and the path of focused light rays passing through its outermost edge. In this manner, overlap of the focal range between the transmitter lens and the textile bobbin and the between the receiver lens and the textile bobbin is avoided, which also avoids possible reflection of light rays from the periphery of the transmitter lens directly into the periphery of the receiver lens, thereby preventing the photooptic detector associated with the receiver lens from detecting such directly reflected rays.

Advantageously, the present invention is adapted to be utilized, alternatively, in a textile bobbin transport system wherein bobbins are conveyed on a belt past the sensing device in order to accomplish relative movement between the bobbins and the sensing device, as aforementioned, or in a transport system wherein textile bobbins are positioned adjacent the sensing device which itself is supported for selective movement lengthwise along the textile bobbin to accomplish such relative movement.

Preferably, in either case, the sensing device is mounted on a support structure which includes a suitable arrangement for biasing the sensing device toward the textile bobbin to maintain a uniform predetermined spacing between the transmitter and receiver lenses and the textile bobbin, which assures optical precision in the operation of the sensing device. However, inasmuch as residual yarn windings on the bobbin can possibly be of a substantially increased diameter relative to the bobbin itself, depending upon the amount and size of the residual yarn winding, it is desirable that the sensing device be provided with an engagement surface adapted to contact such residual yarn on the textile bobbin so as to deflect the sensing device away from the bobbin against the biasing arrangement.

It is additionally preferred that the transmitter lens be in the form of a focusing lens whose focal length is no greater than its spacing from the surface of the textile bobbin, which is effective to form the transmitted light rays in a relatively small focal spot on the surface of the textile bobbin so as to achieve a high density of light rays thereat and, in turn, to enable the detection of individual residual yarn windings.

In the preferred embodiment, the optical axis of the transmitter lens is oriented perpendicularly to the surface of the textile bobbin, which particularly minimizes any influence on the sensing operation of the sensing device by deviations in the surface structure of the textile bobbin.

It can be advantageous to perform the sensing operation utilizing transmitted light in differing spectral ranges, since the reflectivity and optical distinctiveness between the textile bobbin and residual yarn thereon may be accentuated or greater in certain spectral color components as compared to the use of white light. For this purpose, the light transmitter may comprise a plurality of light-emitting diodes which respectively radiate light rays in differing spectral ranges and which are arranged relative to the transmitting lens to direct their respective light rays onto a common focal point. In such case, a suitable arrangement is preferably provided for controlling the diodes to emit their respective light rays in serial pulses.

The present invention additionally enables a direct determination to be made as to the location and amount on a textile bobbin at which a residual yarn winding or windings is present, by means of comparing the sensed values obtained from the photooptic detector at differing points lengthwise along the textile bobbin. Accordingly, the apparatus of the present invention has the capability of distinguishing not only between empty yarn bobbins and bobbins having residual yarn thereon but also to distinguish between residual yarn bobbins having differing amounts of yarn remaining thereon.

For this purpose, the present apparatus is preferably provided with a suitable arrangement associated with the support for the sensing device by which the position of the sensing device along the textile bobbin can be determined at differing points in the operation of the apparatus. Particularly, the sensing device support preferably includes a carriage on which the sensing device is carried, a guide which supports the carriage for reciprocal movement therealong, a drive for driving reciprocal movement of the carriage, a device for generating pulses in relation to reciprocal movement of the carriage, and a device for counting the pulses. A sensor is further provided for detecting the presence of the carriage in a starting position thereof and is associated with the pulse counting device for resetting the device to a zero restarting value when the carriage is in such starting position.

Preferably, the carriage drive is arranged for reciprocating movement of the carriage alternatingly between its starting position and a predetermined maximum moved position, which enables the present apparatus to perform its sensing operation alternatively from top to bottom along a textile bobbin and from bottom to top along a textile bobbin, which eliminates a nonoperative return movement of the sensing device between sensing operations on successive bobbins.

A centering mechanism is also provided for engaging the textile bobbin to maintain its surface which faces the sensing device substantially parallel to the path of movement of the sensing device along the bobbin, thereby to enable the sensing device to be maintained at a constant spacing from the surface of the bobbin during operation.

DESCRIPTION OF THE PREFERRED EMBODIMENT

Figure 1:
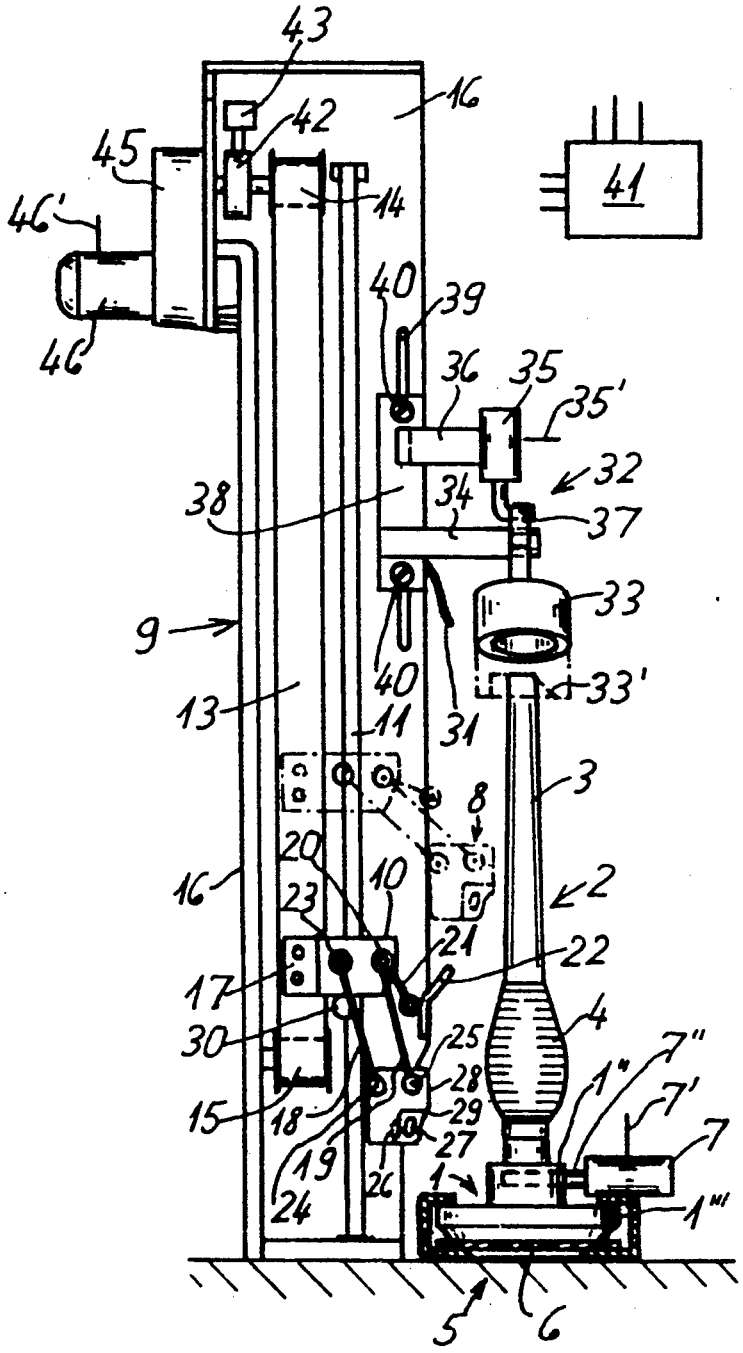
FIG. 1 is a side elevational view of the yarn remnant detecting apparatus according to the preferred embodiment of the present invention.
Figure 2:
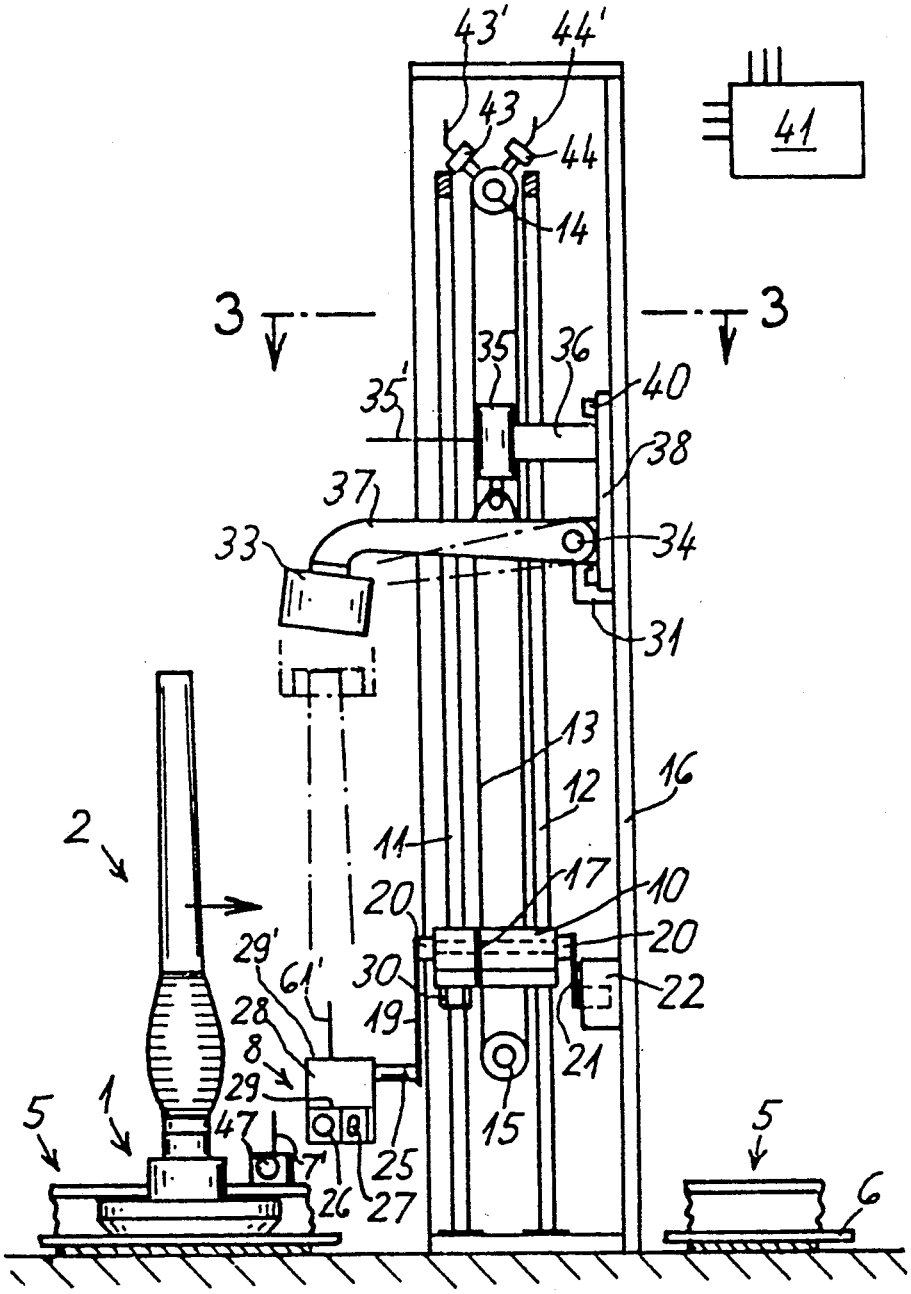
FIG. 2 is a front elevational view of the apparatus of FIG. 1.
Figure 3:
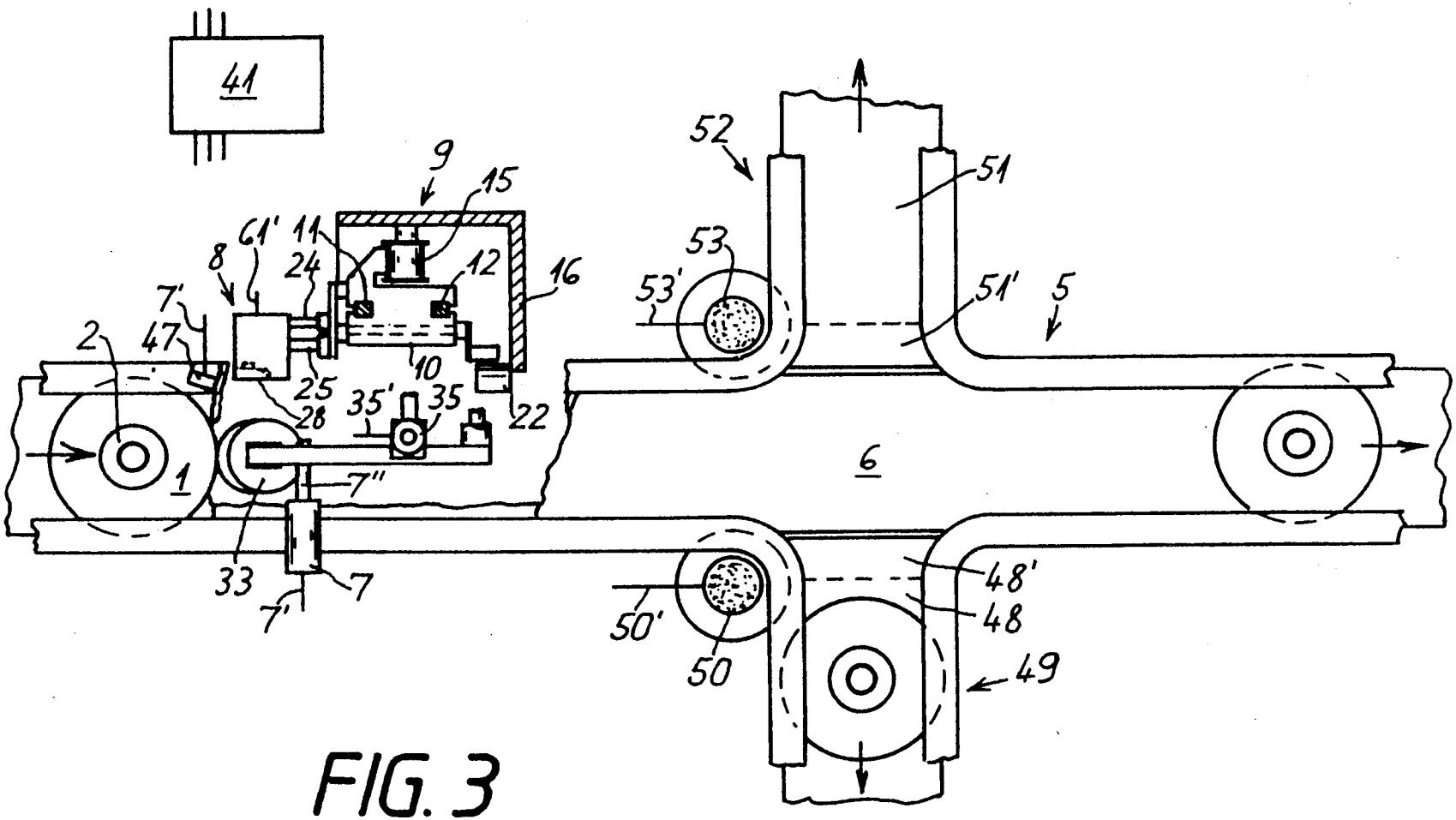
FIG. 3 is a horizontal cross-sectional view of the apparatus of FIGS. 1 and 2 taken along line A—A of FIG. 2.

Referring now to the accompanying drawings and initially to FIGS. 1-3, the yarn remnant detecting apparatus of the present invention and particularly the sensing device it utilizes are illustrated and described herein in one preferred embodiment for use in checking of cop-wound yarn bobbins for yarn remnants, since the advantages of the invention are particularly utilizable in the case of cop-wound bobbins.

As shown in FIGS. 1-3, cops 2 are supplied sequentially along a transport conduit 5 by means of a conveyor belt 6. The cops 2 are supported for transport on conventional peg trays 1 which are independent of each other and are entrained by the conveyor belt 6 by means of friction. The transport conduit 5 includes lateral side flanges which extend along the opposite sides of the belt 6 and serve to guide the peg trays 1.

In order to inspect each cop 2 to determine the presence or absence of residual yarn windings thereon as the cops 2 travel in sequence along the transport conduit 5, a sensing station, shown in its totality in FIGS. 1-3, is disposed at a selected location alongside the transport conduit 5 and basically comprises a stop arrangement 7 for temporarily holding each cop 2 in sequence at the sensing station while a sensing operation is performed, and a sensing head 8 mounted for vertical movement on a lifting mechanism 9 supported on an upright stand structure 16 for movement of the sensing head 8 lengthwise along each cop 2 while held at the sensing station, all as more fully explained hereinafter. As shown in FIG. 3, secondary transport conduits 49,52 branch from opposite sides of the transport conduit 5 downstream of the sensing station for diversion onto the transport conduit 49 of cops 2 having a sufficient amount of residual yarn thereon to be reusable and diversion onto transport conduit 52 of cops 2 having only small non-usable residual yarn windings while completely empty cops 2 remain on the transport conduit 5, as also more fully described hereinafter.

As best seen in FIGS. 1 and 2, the peg trays 1 are of the conventional type having a circular disk-like base plate 1''' from the upper side of which centrally projects a circular pedestal 1'' with a smaller diameter concentric peg extending upwardly therefrom. Thus, the bobbin tube 3 of each cop 2 is telescopically mounted on the peg of its respective peg tray 1 to rest in upstanding disposition on the pedestal 1'' while the base plate 1''' rests directly on the upper surface of the conveyor belt 6.

The stop arrangement 7 basically includes a fluid-actuated cylinder from which a reciprocable stop arm 7'' may be extended and withdrawn horizontally across the conveyor belt 6 at an elevation thereabove corresponding to the height of a peg tray pedestal 1'' when supported on the conveyor belt 6 for selective engagement with the pedestals 1'' of each peg tray 1 in sequence to effectively stop and hold each peg tray 1 and its supported cop 2 at the sensing station. The stop arrangement 7 may be controlled, alternatively, either by a central microprocessor, logic controller, or other suitable control unit, only representatively indicated at 41, or by a sensor 47 located just upstream along the transport conveyor 5 from the stop arrangement 7, in either case a control signal being supplied to the fluid cylinder of the stop arrangement 7 through a control lead 7' for extension and withdrawal of the stop arm 7''.

The stopping of each peg tray 1 at the sensing station by engagement of the peg tray pedestal 1'' has the advantage that, in situations wherein a backup of peg trays 1 in line behind the sensing station occurs, the base plates 1''' of the peg trays 1 abut one another producing an inherent spacing between the pedestals 1'' of adjacent peg trays 1 in sequence, which spacing enables the stop arm 7'' of the stop arrangement 7 to be withdrawn to release a peg tray 1 and its supported cop 2 from the sensing station and then to be re-extended into the transport path 5 in advance of the arrival of the pedestal 1'' of the next succeeding peg tray. As necessary or desirable, the fluid actuating cylinder or other actuating mechanism for the stop arm 7'' can be located to extend partially over the transport path 5 at an elevational slightly above the peg tray base plates 1''' so that the extension and withdrawal stroke of the stop arm 7'' can be minimized to facilitate rapid operation of the present invention.

A cop alignment mechanism 32 is mounted on the stand 16 at the sensing station to center or otherwise align and hold each cop 2 in a desired orientation with respect to the sensing head 8, preferably with the peripheral surface of the winding tube 3 of each cop 2 at the side thereof facing the sensing station being oriented in a substantially vertical orientation, to insure that a uniform spacing is achieved between the sensing head 8 and each cop 2 in sequence throughout the full rage of sensing movement of the sensing head 8.

Basically, the centering or aligning mechanism 32 includes a downwardly opening cup-shaped centering head 33 affixed to the end of a support arm 37 pivoted on a shaft 34 extending outwardly from the stand 16 for upward and downward movement of the centering head 33 relative to the transport conduit 5. A fluid cylinder 35 is supported on an arm 36 extending outwardly from the stand 16 above the pivot arm 34 for actuating upward and downward pivoting movement of the support arm 37 and its centering head 33. Both the pivot arm 34 and the cylinder mounting arm 36 are affixed to a carrier 38 which is mounted via a pair of stop screws 40 in elongated holes 39 of the stand 16, by which mounting the position of the centering device 32 of the stand 16 can be selectively adjusted to accommodate cops of differing lengths.

In any case, the carrier 38 for the centering device 32 is adjustably positioned so that, in the downward position of the pivot arm 37 and the centering head 33, the upper end of the tube 3 of a cop 2 positioned at the sensing station is engaged in the centering head 33 and, in turn, upward pivoting of the arm 37 is required to release the cop 2 for continued conveyance along the transport conduit 5 downstream from the sensing station. Actuation of upward and downward movement of the support arm 37 is controlled by the central control unit 41 to occur either cyclically or in response to an appropriate input, such as the aforementioned sensor 47 (which therefore necessarily would be connected to the central control unit 41). Alternatively, as more fully described in German Patent DE 39 19 106 A1, which is hereby incorporated herein by reference, each peg tray 1 could be equipped with an annular iron ring about the circumference of the base plate 1''' for recognition by an appropriate proximity sensor located at the sensing station for detecting the presence of a peg tray 1 thereat. This form of peg tray 1 would provide the additional advantage of enabling each peg tray's movement to be further controlled with the assistance of electromagnets located along the transport conduits, as described hereinafter.

The interior profile of the centering head 33 is generally conical except for the provision of a surface 33' at the side of the centering head 33 away from the sensing head 8. By this interior configuration, the centering head 33 is effective upon engagement with each cop tube 3 to pivot the tube out of precisely vertical alignment by a sufficient angular degree corresponding to the conicity of the tube 3 so that its peripheral surface facing the sensing head 8, rather than the tube axis, is vertical. Alternatively, the lifting device 9 associated with the sensing head 8 or the entire stand 16 could be arranged to be capable of being inclined in similar manner to a degree corresponding to the conicity of the particular cop tubes 3 being processed. Further, where the particular tubes 3 are only slightly conical, it is possible for the sensing head 8 to perform a reliable determination of the presence or absence of residual yarn on the tubes 3 by movement of the sensing head parallel to the tube axis rather than to the peripheral surface of the tube. In embodiments of the first-described type utilizing the interiorly profiled centering head 33, it may be necessary when performing sensing operations on cop tubes having a relatively large conicity to form the transport conduit 5 with a sufficient recess beneath the conveyor belt 6 to accommodate a corresponding inclination of each peg tray 1 without clamping or otherwise retarding continued movement of the conveyor belt 6.

As will be understood, in a circumstance in which the centering head 33 is pivoted downwardly past a point at which it would normally engage the upper end of a cop tube 3, this occurrence would indicate that the peg tray 1 then present at the sensing station does not have a cop tube 3 supported thereon. Accordingly, to signal operating personnel as to this condition, the centering mechanism 32 can be equipped with an additional sensor, e.g., in association with the fluid cylinder 35 or adjacent to the support arm 37. Alternatively, a sensor could be provided above the sensor 47 to similarly determine the presence or absence of a cop tube 3 on each peg tray 1 in sequence. In this manner, the sensing station can additionally be utilized to insure that empty peg trays 1 are not conveyed downstream from the sensing station.

Figure 4:
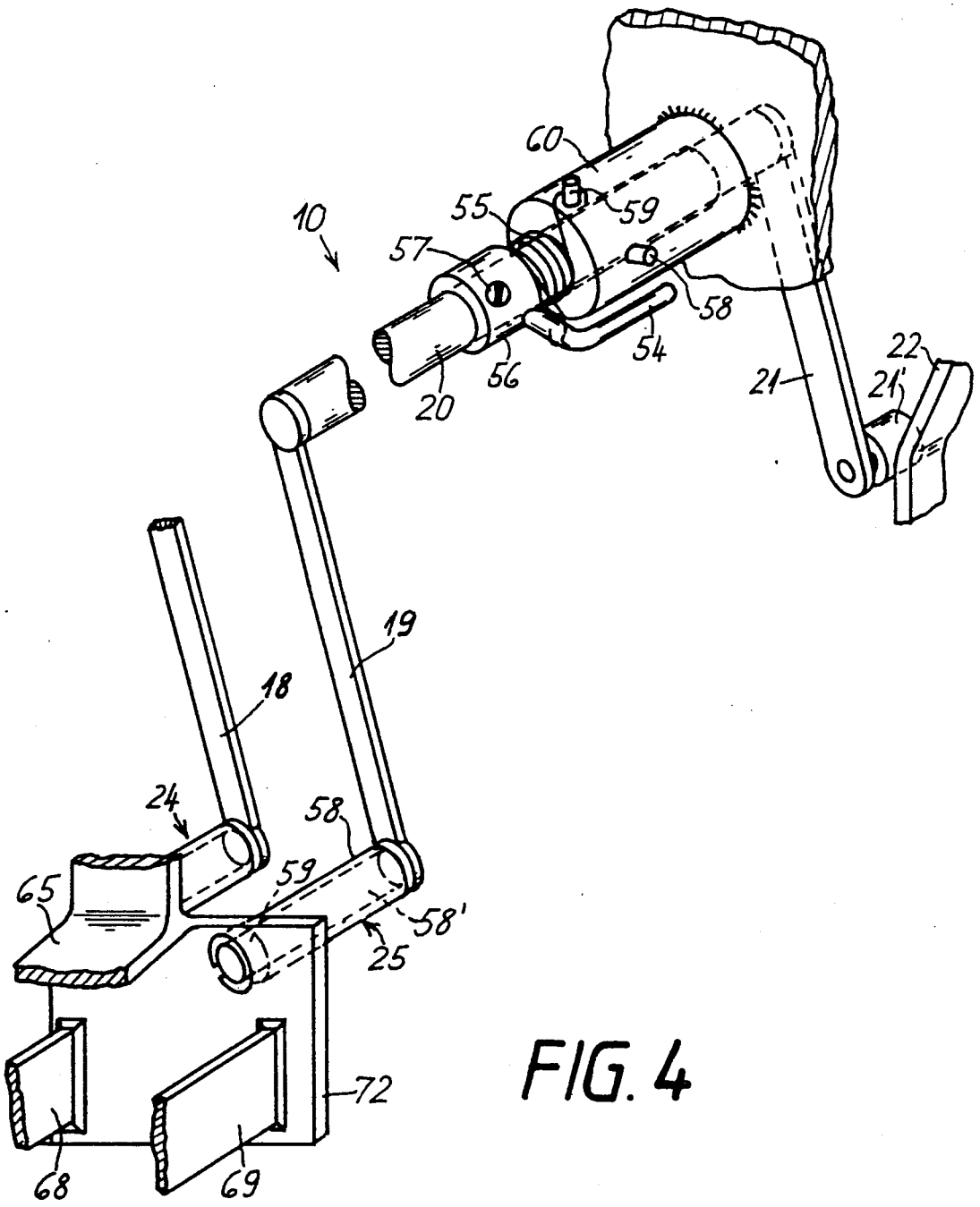
FIG. 4 is a perspective view of the lifting carriage of the apparatus of FIGS. 1 and 2 showing the mounting for the measuring device.

As best seen in FIG. 4, the lifting device 9 supports the sensing head 8 on a lifting carriage 10 by means of a pair of parallel support arms 18,19. The lifting carriage 10, in turn, is supported on vertical guide rails 11,12, of the stand 16 and is affixed via a mounting bracket 17 to a vertically-oriented endless lifting belt 13 trained about upper and lower deflection rollers 14,15 for vertical movement of the lifting carriage 10 and its supported sensing head 8 upwardly and downwardly along the stand 16. The deflection roller 14 is connected via a transmission mechanism 45 to a drive motor 46 for driving movement of the lifting belt 13. A wheel 42 (FIG. 1) is affixed coaxially on the shaft connecting the deflection roller 14 to the transmission 45 for integral rotation therewith and is provided on its annular circumference with a plurality (e.g. 60) of magnetic poles uniformly spaced thereabout. A pair of Hall sensors 43,44, or other suitable proximity sensors, are disposed adjacent the periphery of the wheel 42 and connected via signal leads 43',44', respectively, to the central control unit 41, for supplying signal impulses to the control unit 41 in correspondence to the rotation of the wheel 42. By counting the impulses received from the sensors 43,44, the control unit is enabled to continuously determine and monitor the position of the lifting belt 13 and thereby the elevation of the lifting carriage 10 and the sensing head 8 relative to the stand 16.

The provision of two sensors 43,44 enables the sensing device to be automatically returned to an initial starting position even after a manual change is made in the position of the lifting carriage 10. For this purpose, the sensors 43,44 are spaced from one another so as to be staggered or offset relative to the magnet poles on the wheel 42, i.e., when one of the sensors is directly adjacent one magnet pole of the wheel 42 the other sensor is disposed directly between two adjacent magnet poles. Accordingly, the central control unit 41, in addition to counting the pulses received from the sensors 43,44, is enabled to determine the direction of movement of the lifting belt 13 and, in turn, to control return of the lifting carriage 10 and the sensing head 8 to an initial starting position even after a manual intervention changing the position of the lifting carriage 10 takes place. In addition, the provision of two sensors 43,44 staggered in the manner described provides basically twice the precision in measuring the movements of the lifting belt 13. On the other hand, those persons skilled in the art will recognize that the present apparatus will also function sufficiently with only one sensor, if desired.

The transmission 45 and the drive motor 46 are preferably provided with a brake (not shown) by which the lifting carriage 10 and the sensing head 8 may be retained in a fixed controlled position when the motor 46 is at a standstill, without the weight of the carriage 10 and the sensing head 8 causing unintentional shifting movement thereof.

In normal operation, the sensing head 8 travels upwardly and downwardly by movement of the lifting belt 13 between predetermined uppermost and lowermost positions, memory values of which can be input into and stored within the central control unit 41 and, as necessary, selectively changed. As will be understood, since the peg trays 1 are typically of uniform size and since cop tubes 3 of varying sizes typically have a relatively uniform lower foot portion so that the lowermost extreme of yarn windings on differing cop tubes 3 are characteristically at a relatively uniform location and height relative to the cop foot regardless of differences in the length of cop tubes, the lowermost extreme position of the sensing head 8 is typically fixed and does not vary with changes in the cop tubes being processed. In turn, such lowermost extreme position of the sensing head 8 can consequently also serve for calibration of the pulse counting device within the sensor control unit 41. Specifically, a buffer 30 may be arranged on the guide rail 11 to form a lowermost stop for the lifting carriage 10 and, at the same time, to serve as a proximity sensor connected with the control unit 41 for automatically resetting its counting device to a zero value upon each return of the lifting carriage 10 to its lowermost extreme position. Alternatively, a suitable marking (not shown) could be placed on the lifting belt 13 so as to be detectable in the lowermost position of the lifting carriage 10 by means of a sensor arranged at an appropriate height. The drive speed of the motor 46 can be controlled via a control lead 46' from the central control unit 41 so as to reduce its drive speed when approaching the lowermost extreme position of the lifting carriage 10, thereby enabling the lifting carriage 10 to be stopped precisely in such lowermost position without requiring a strong braking force.

As shown in FIG. 4, the support arm 19, which together with the support arm 18 suspends the sensing head 8 from the lifting carriage 10, is affixed to a shaft 20 extending through the lifting carriage 10. A lever 21 extends downwardly from the opposite end of the shaft 20 and carries a feeler roller 21' which is positioned to engage a stop member 22 fastened to the stand 16 when the measuring head 8 is disposed in its lowermost extreme position. Upon engagement of the feeler roller 21' with the stop member 22, the lever 21, the shaft 20, the support arm 19 and the sensing head 8 pivot rearwardly as a unit about the lengthwise axis of the shaft 20. During such rearward pivotal movement, the parallel pair of support arms 18,19 insure that the disposition of the sensing head 8 relative to the cop 2 does not change, which is especially significant in movements of the sensing head away from the surface of a cop tube 3. This pivoting of the support structure for the sensing head 8 in its lowermost extreme position is necessary if, in such position, the feeler arm 21 could otherwise potentially contact a peg tray 1 at the sensing station. Such pivoting movement of the sensing head support arrangement may also be necessary if the sensing head 8 is operable to move alternatingly in both upward and downward directions for detecting residual yarns, such that the sensing head 8 must be pivoted in its lowermost position sufficiently away from a new cop 2 arriving at the sensing station to avoid contact with any residual yarn windings on the cop.

Another stop member 31, similar to the stop member 22, may be provided on the stand 16 in the area of the uppermost extreme position of the lifting carriage 10 and the sensing head 8, so as to cause the sensing head 8 to pivot rearwardly away from a cop 2 at the sensing station upon reaching the uppermost extreme position. Thus, the stop member 31 assures that, during upward and downward movement of the lifting carriage 10, the sensing head 8 is not moved toward a cop 2 at the sensing station into closely spaced sensing disposition adjacent the periphery of its tube 3 until the sensing head 8 is at an elevation corresponding to the uppermost location along the tube 3 at which yarn could be wound. As will be understood, the stop member 31 can be selectively positioned, as desired, at a location farther down the height of the stand 16 if the decision is made that there is no interest or no need to be concerned with sensing for residual yarn windings near the upper end of the tube 3, which may be particularly true of cop-wound bobbins or tubes. On the other hand, if it is desired to sense for residual yarn windings along the full length of tubes 3, it may be necessary or desirable to flatten or otherwise recess the side of the centering head 33 facing the sensing head 8 in order to avoid undesirable contact therebetween during upward and downward movement of the sensing head 8. Such modification of the centering head 33 should not present any particular problems since the aforementioned tipping or inclination of the cops 2 carried out by the centering head 33 is predominantly controlled and executed by the opposite side of the centering head 33 as above described.

As will also be apparent from FIG. 4, the pivoting motion of the shaft 20 connecting the sensing head support arm 19 and the pivot control lever 21 is influenced by the provision of a concentric spring 55 connected at one end to a retaining stud 59 on a hub 60 affixed to the lifting carriage 10 through which hub the shaft 20 rotatably extends and connected at the opposite end to a right-angle stop bolt 54 on a sleeve 56 which is rigidly affixed to the shaft 20 by a set screw 57. In this manner, the spring 55 serves to bias the shaft 20 to urge its rotation in a counter-clockwise direction, as viewed in FIG. 4, into a position wherein the stop bolt 54 rests against another stud 58 on the hub 60. Since the hub 60 is rigidly affixed to the lifting carriage 10, the position of the stop stud 58 is correspondingly fixed and thereby serves to limit horizontal movement of the sensing head 8 in the direction of a cop 2 at the sensing station, which assures that the sensing head 8 always tends to assume such position during each reciprocal movement upwardly and downwardly during each sensing operation on each cop 2 at the sensing station. As will be understood, the limitation imposed on the forwardmost horizontal position of the sensing head 8 may be selectively and simply adjusted by loosening of the set screw 57 and selective rotation of the sleeve 56 relative to the shaft 20 followed by re-tightening of the set screw 57, such as would be desirable when a differing type or size of cop or tube is to be processed through the sensing station.

FIG. 4 also shows the manner by which the parallel support arms 18,19 are connected to the sensing head 8. As shown, a shaft 75 is affixed to and extends outwardly from the downward end of the support arm 19 and is fitted rotatably, e.g., by means of a spring or snap ring or the like, within a sleeve 76 which is affixed to a holding plate 72 for the sensing head 8 by a weld, solder, or other permanent connection, thereby forming a rotationally articulated joint 25. The support arm 18 is correspondingly affixed by a like rotary joint 24 to the holding plate 72 in parallel spaced relation to the rotary joint 25.

With reference to FIG. 3, the aforementioned transport conduits 49,52 which branch from the main transport conduit 5 correspond thereto in basic construction. The transport conduit 49 includes an endless conveyor belt 48 which extends about a deflection roller 48' disposed immediately alongside the conveyor belt 6 and a corresponding remotely located deflection roller (not shown). Similarly, the transport conduit 52 includes an endless conveyor belt 51 which extends about a deflection roller 51' immediately adjacent the conveyor belt 6 and another remote deflection roller (not shown). In each case, the conveyor belts 48,51 are driven to travel respectively away from the main conveyor belt 6.

Each of the transport conduits 49,52 is provided with an associated shunt arrangement for selectively diverting peg trays 1 discharged from the sensing station onto the conveyor belts 48,51. Specifically an electromagnet 50 is located at the intersection of the conveyor belt 48 and the main conveyor belt 6 and is selectively energized and de-energized via a control lead 50' from the central control unit 41 upon each discharge of a cop 2 from the sensing station as a function of the result of the sensing operation performed on the cop 2. Similarly, an electromagnet 53 is disposed at the intersection between the main conveyor belt 6 and the conveyor belt 51 and is correspondingly controlled via a lead 53' from the central control unit 41. To facilitate such diversion of the cops onto either branch conveyor 48,51, the peg trays 1 are preferably of the aforementioned form equipped with a circumferential iron ring annularly about the base plate 1''' of each peg tray 1.

Thus, in operation, when a cop 2 at the sensing station is sensed to have a sufficient amount of residual yarn remaining thereon to warrant return of the cop to a winder for further yarn unwinding therefrom, the central control unit 41 energizes the electromagnet 50 via its control lead 50' upon discharge of the cop from the sensing station. Thus, as the cop and its supporting peg tray 1 travel downstream from the sensing station, the annular iron ring of the peg tray is attracted by the energized electromagnet 50 causing the peg tray and its supported cop to be diverted onto the conveyor belt 48, which preferably transports such cops to a yarn end preparation device from which they can be returned to a bobbin winding machine. In similar manner, when a cop 2 at the sensing station is sensed to have only a small non-reusable amount of residual yarn thereon, the central control unit 41 energizes the electromagnet 53 to correspondingly divert the cop and its peg tray onto the conveyor belt 51, which preferably transports such cops to a tube cleaning device. Alternatively, all cops sensed to have residual yarn thereon can be diverted onto the transport conduit 49 with the appropriate segregation of such cops according to the amount of residual yarn thereon being carried out at a downstream location along the transport conduit 49, in accordance with the teachings of German Patent DE 40 09 318 81. When cops are sensed at the sensing station to have no residual yarn thereon, the electromagnets 50,53 remain de-energized, whereby such cops upon discharge from the sensing station are transported downstream along the main conveyor belt 6.

Figure 5:
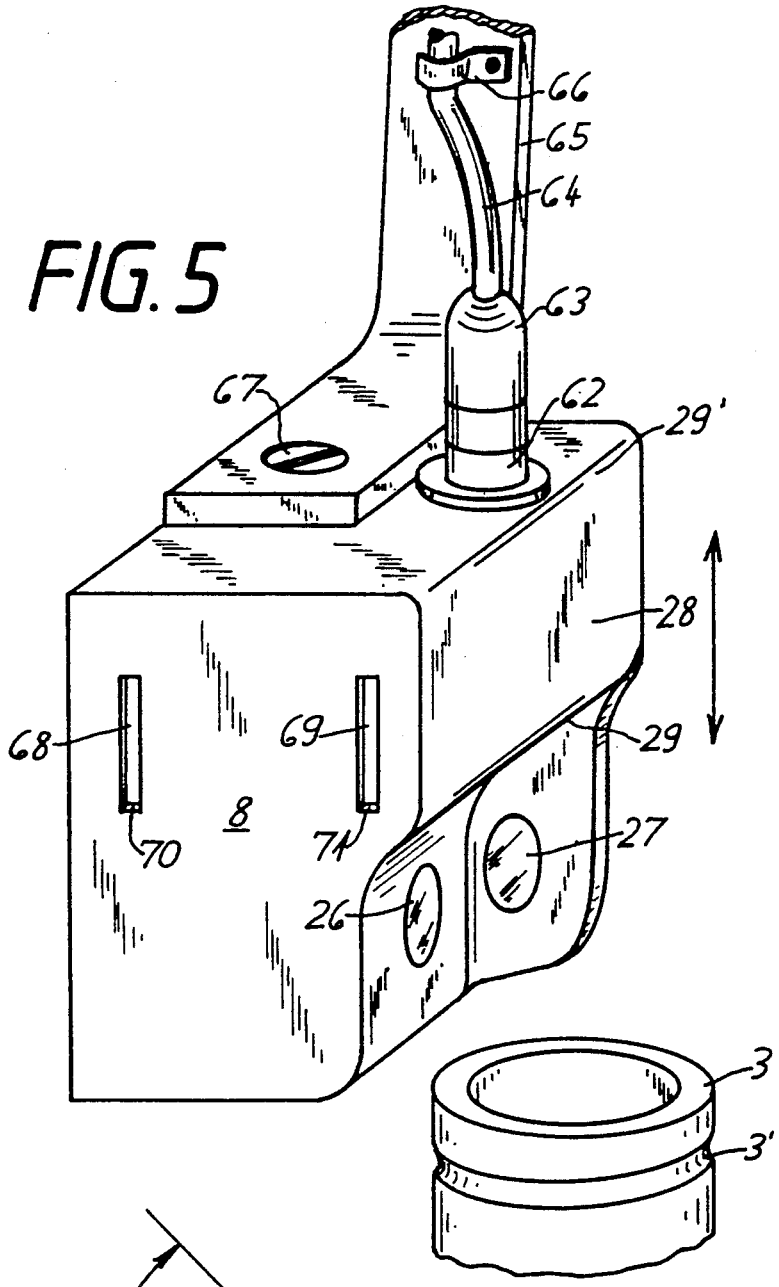
FIG. 5 is a perspective view of a preferred form of device for the present apparatus.

A preferred form of the sensing head 8 of the present invention is shown in perspective view in FIG. 5. The housing of the sensing head 8 is formed with guide slots 70,71 which extend transversely therethrough to receive support bars 68,69, respectively, which are affixed to the holding plate 72 shown in FIG. 4. This manner of mounting of the sensing head 8 to the holding plate 72 permits simplified replacement of any potentially defective sensing head. The housing of the sensing head 8 may be secured to the rearward support bar 68 by a set screw (not shown). Alternatively, or in addition, the housing of the sensing head 8 may be affixed to the mounting plate 72 by a bracket 65 to which the sensing head 8 is secured via a fastening screw 67. As shown in FIG. 4, the bracket 65 may be formed integrally with the mounting plate 72.

A socket 62 is formed in the upward surface of the sensing head 8 for receipt of a control plug 63 and a connecting cable 64 through which all control leads between the sensing head 8 and the central control unit 41 extend. The cable 64 may be secured to the holder 65 by a suitable clamp 66. A transmitter lens 26 and a receiver lens 27 are supported within a recessed area at the lower end of the forward side of the sensing head 8 which faces the position occupied by cops at the sensing station.

The forward side of the sensing head 8 above the recessed area wherein the transmitter and receiver lens 26,27 are supported forms an engagement surface 28 having rounded upper and lower borders 29,29'. The engagement surface 28 is thus configured for non-damaging engagement with enlarged residual yarn windings present on some cop 2 during upward and downward sensing movements of the sensing head 8 by means of the lifting device 9, which contact imparts rearward pivoting movement of the sensing head 8 unitarily with its parallel supports arms 18,19 and the support shaft 20 against the biasing force of the spring 55, as above-described. As already mentioned, the parallel arrangement of the support arms 18,19 insures that the relative facing relation and spatial orientation of the sensing head 8 with respect to the cop 2 does not change during or as a result of such pivoting movement. As a result of the transmitter and receiver lenses 26,27 being recessed relative to the engagement surface 28, the lenses 26,27 do not contact the residual yarn windings. The rounded upper and lower borders 29,29' of the engagement surface 28 insure that the sensing head 8 slides readily over such residual yarn windings without damaging the yarn.

Figure 6:
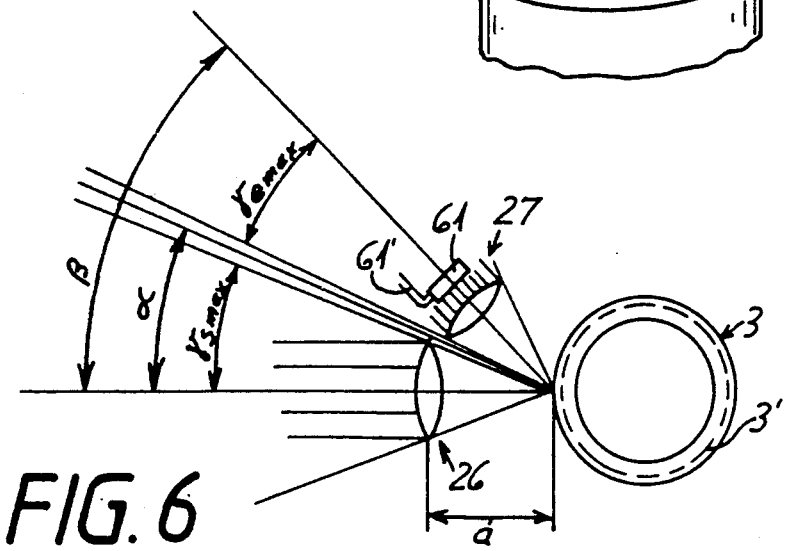
FIG. 6 is a schematic illustration of the relationship between the transmitter lens, the receiver lens and a textile bobbin tube utilizing the present apparatus.

As seen in FIG. 5, the transmitter and receiver lenses 26,27 are arranged in a substantially horizontal plane generally perpendicular to the lengthwise extent of the tube 3 of a cop 2 located at the sensing station. FIG. 6 schematically illustrates in top plan view the relative orientation of the lenses 26,27 with respect to one another and with respect to a tube 3 positioned at the sensing station. The sensing head 8 includes a light beam transmitter or another suitable light source arranged to direct a limited beam of light rays through the transmitter lens 26 toward the surface of the tube 3, only representatively indicated in FIG. 6 as parallel lines entering the transmitter lens 26. To this end, a diaphragm or aperture may be provided in front of the transmitter lens 26 through which the incoming light rays are directed to the transmitter lens 26. Essentially parallel incoming light rays to the transmitter lens 26 can be obtained by providing a sufficient spacing between the light source and the lens 26 or, alternatively, by providing a focusing lens (not shown) to parallelize the incoming light. These techniques are well known in the field of optics and therefore need not be described in greater detail herein.

The transmitter lens 26 itself acts as a focusing lens and is arranged with its focal point coincident with the peripheral surface of the tube 3 so that the light rays passing through the transmitter lens 26 are focused to strike the surface of the tube 3 at their focal point. Optionally, the transmitter lens 26 can be arranged relative to the tube 3 so that the surface of the tube 3 is behind the focal point of the lens. The receiver lens 27 is also in the form of a focusing lens and is arranged relative to the surface of the tube 3 so that its focal point substantially coincides with the focal point of the transmitter lens 26. A photosensor 61 is disposed behind the receiver lens 27. A portion of the light rays focused by the transmitter lens 26 onto the surface of the tube 3 are reflected directly back toward the transmitter lens 26, especially as a result of extant luster on the surface of the tube 3, and therefore this portion of the transmitted light is not received by the receiver lens 27 o the photosensor 61. As a result of the common focal point of the transmitter and receiver lenses 26,27, only the light rays focused on the surface of the tube 3 by the transmitter lens 26 are reflected through the receiver lens 27 and are received by the photosensor 61. Advantageously, the small size of this common focal point or spot enables even individual yarns to be detected by means of the photosensor 61.

As is also apparent from FIG. 6, the transmitter and receiver lenses 26,27 are disposed with their respective optical axes oriented angularly with respect to one another and with respect to the cop tube 3 such that a line intersecting the vertex of the two optical axes (i.e., the point of their intersection) and bisecting the angle between the two optical axes is not perpendicular or normal to the peripheral surface of the cop tube 3 at such vertex or focal point of the lenses, as is the case with the prior art, but rather such bisecting line angularly deviates from such a perpendicular line at the vertex by an angle of deviation $\alpha$ of at least about ten degrees (10°) and, more preferably, in the range of twenty degrees (20°) or more as illustrated. This orientation is accomplished in the embodiment shown in FIG. 6 with the optical axis of the transmitter lens 26 oriented perpendicularly or normal to the outer peripheral surface of the cop tube 3 so as to coincide with the vertical line against which the angle of deviation $\alpha$ is measured.

As will also be recognized, in the preferred embodiment illustrated, the angle between the two optical axes of the transmitter and receiver lenses 26,27, indicated in FIG. 6 as the angle $\beta$, is greater than the sum of the angles $\tau_s$ max, representing the maximum focal angle of the transmitter lens 26 measured between its optical axis and the outermost path or line of incidence at which light rays passing through the outermost edge of the lens 26 can be focused on its focal point, and the corresponding angle $\tau_e$ max, representing the corresponding maximum focal angle of the receiver lens 27 similarly measured between its optical axis and the outermost path or line of incidence by which light rays passing through its outermost edge may be focused on the focal point of the lens 27.

By this relative orientation of the lenses 26,27, any potential overlap of the effective focal ranges of the two lenses 26,27, respectively, is avoided, which in turn prevents any portion of light rays from the light source passing through the transmitter lens 26 and directly reflected back by the surface of the tube 3 from passing into and through the receiver lens 27 to thereby be recognized by the photooptic detector 61. Alternatively, however, it is also contemplated that the transmitter and receiver lenses 26,27 may be arranged with some overlap existing in their respective focal ranges without impairing or affecting the reliability of the sensing results obtained by the photooptic detector 61 so long as the detector 61 is sufficiently smaller in dimension than the focusing rang of the receiver lens 27 to prevent the detector 61 from receiving light rays which are directly reflected by the cop tube 3 back within the focal range of the transmitter lens 26.

Figure 7:
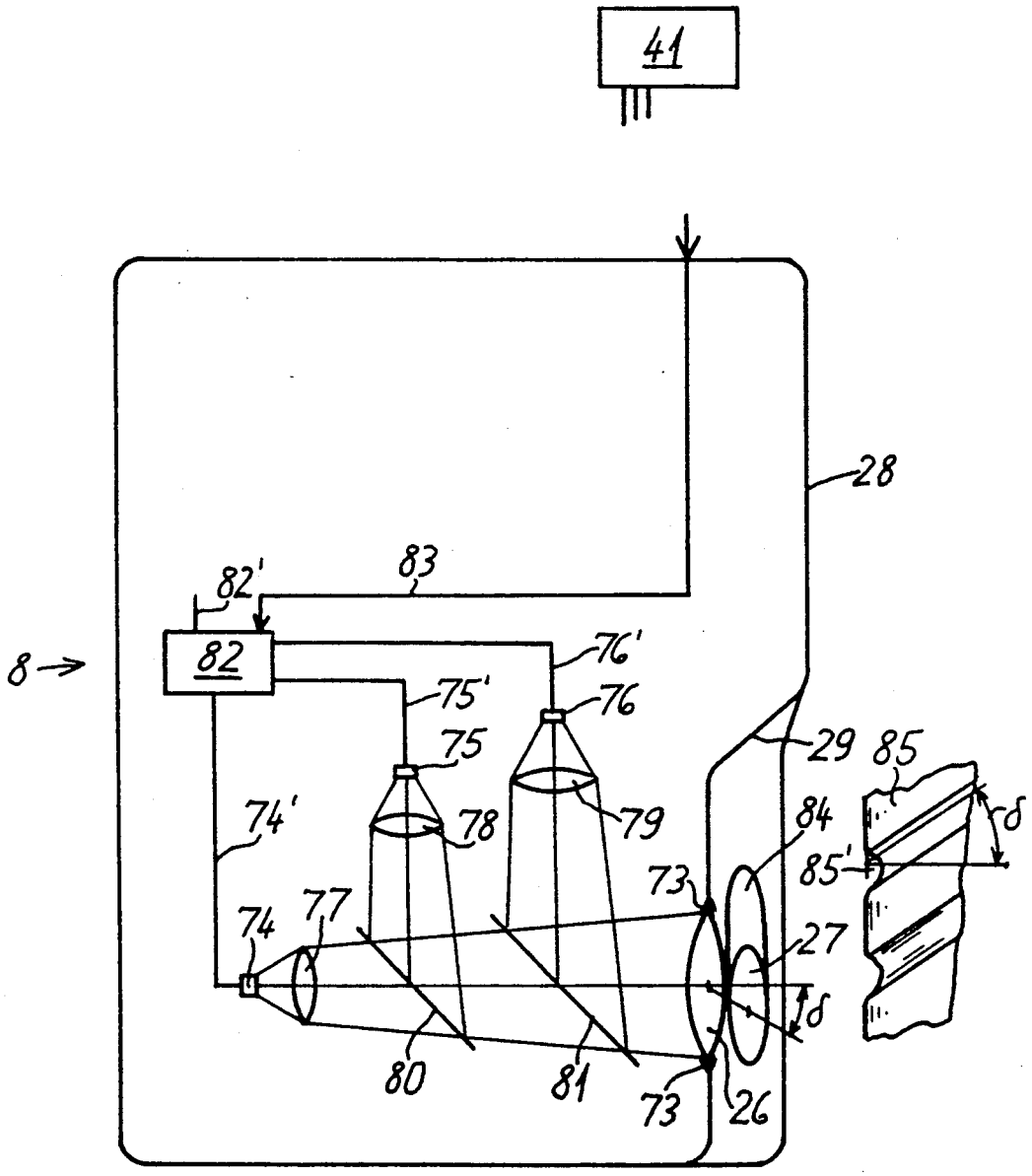
FIG. 7 is a schematic illustration of a measuring device for the present apparatus utilizing a transmitting device for rays in various spectral ranges.

Referring now to FIG. 7, one contemplated embodiment of a suitable light source for the sensing head 8 utilizing three light-emitting diodes 74,75,76, is shown schematically. These light-emitting diodes 74,75,76 are selected for their capability of radiating light in differing spectral ranges, e.g., of differing spectral color frequencies, and are controlled to emit their respective light beams in pulses in series with one another by means of respective control leads 74',75',76' from a common control unit 82 within the sensing head 8, which in turn is controlled via a control lead 83 from the central control unit 41. In the simplest case, the control signal from the central control unit 41 to the control unit 82 may merely comprise start and stop signals at the beginning and completion of each sensing operation.

A respective focusing lens 77,78,79 is associated with each light-emitting diode 74,75,76, to initially focus its respective light beam pulses, and an arrangement of dichroic mirrors 80,81, is provided to direct the respective light beams of each of the light-emitting diodes 74,75,76 onto the transmitter lens 27. Each of the dichroic mirrors 80,81 is capable of permitting the light rays from the light-emitting diode 74 to pass through the mirrors 80,81 within a predetermined limited spectral range. However, the dichroic mirror 80 associated with the light-emitting diode 75 acts as a reflective mirror with respect to the spectral range of the light rays generated by this diode 75 so as to prevent passage of these light rays through the mirror 80 and instead to reflect such rays into the same light beam path as the light rays generated by the light-emitting diode 74. The dichroic mirror 81 similarly acts as a reflective mirror with respect to the light rays in the spectral range of the light-emitting diode 76 to reflect these light rays also into the same light beam path as that produced by the light-emitting diode 74, while being adapted to permit the light rays from the light-emitting diode 75 as well as the light rays from the diode 74 to pass through the mirror 81. In this manner, each pulse of light generated in sequence by the light-emitting diodes 74,75,76 is directed in the same path onto and through the transmitter lens 26.

The operation of the sensing apparatus of the present invention may thus be understood based upon the evaluation of light rays generated within differing spectral ranges as in the abovedescribed embodiment. Initially, in order to recognize individual yarns and multiple yarn windings on the cop or bobbin tubes to be processed, the particular color of the tubes themselves and the color of the yarn wound thereon are first measured separately, at which time the extant three spectral color components of a mixture of the detected colors are measured and all of the measured values are stored in the central control unit 41. The color values of the tube itself can be identified as such at the beginning of a sensing operation, since the starting point in the movement of the sensing head 8 vertically along a tube at the sensing station, whether traveling downwardly from the upper end of the tube or upwardly from the lower end of the tube, will initially travel adjacent a portion of the tube which is free of yarn windings in either case Thereafter, the color components of the tube and any yarn windings thereon as detected by the photooptic detector 61 are compared separately against the stored values within the central control unit 41 and, upon a predetermined deviation of at least one color component, a signal indicating the presence of residual yarn on the tube is transmitted to the central control unit 41.

The frequency of the pulses of light transmitted by the light-emitting diodes 74,75,76, is preferably greater than one kilohertz. Output signal leads 61' from the photooptic detector 61 are connected with an electronic comparison circuit (not shown) which is supplied by the diode control unit 82 via a control lead 82' with comparison signals at the same cyclical sequence and timing as the light-emitting diodes 74,75,76. This arrangement involves known electronic componentry and therefore need not be more fully described.

The portion of the light rays from the light-emitting diodes 74,75,76 which are backscattered from the peripheral surface of a cop at the sensing station and are received through the receiver lens 27 by the photooptic detector 61 are transmitted as corresponding signals via the signal leads 61' to the central control unit 41, which as aforementioned comprises a microprocessor, logic controller, computer, or the like for purposes of evaluating and processing such signals. Within the central control unit 41, the successive color component signals received by the control unit 41 are associated with corresponding individual points in the range of sensing movement of the sensing head 8 as signaled by the sensors 43,44. Additionally, any mixed color values determined for the individual measuring points are associated with the particular location of the sensing head 8 in its sensing movement. As a result, a sensing operation is stored and performed in the central control unit 41 which not only enables the existence of a residual yarn winding to be determined but also its position along the cop tube being sensed, whereby precise determinations can be made as to the amount of residual winding remaining on the tube. In turn, as aforementioned, the central control unit 41 controls segregation of each cop passing through the sensing station according to the particular result of the sensing performed thereon, by means of selective energization and de-energization of the electromagnets 50,53 at the branch conduits 49,52 via the control leads 50',53', as shown in FIG. 3.

As a result of the capability of the present invention for relatively precisely distinguishing residual yarn windings essentially without graduated steps, the operator of the present apparatus can determine through programming of the central control unit 41 the desired minimum amount of residual yarn winding which is deemed suitable for returning a cop to the winding machine for further unwinding of yarn therefrom. It is also contemplated within the scope of the present invention that the central control unit 41 could be adapted to impart relevant information to each residual yarn cop concerning the amount of remaining yarn thereon by appropriate conventional means, such as encoding a memory chip or other information carrier affixed to the cop tube or the peg tray. Such information could then be read by a suitable reading device in the winding machine to control handling of the returning cop by the machine, e.g., such as to control shunts or the like in the conveyor or other transport supply system to the winding machine to determine to which winding station the returning cop is to be transported. Likewise, such information on the returning cop could be read by an appropriate reading device at the winding station for use in controlling the handling of the cop thereat, e.g., to allow the microprocessor or computer which controls the winding station to adjust the winding speed as the residual yarn on the cop is unwound to minimize tension increases at the end of the unwinding operation.

The pulsed transmission of each color component of light by the light-emitting diodes 74,75,76 serves, among other things, to compensate for and minimize the influence of extraneous light on the sensing operation. A relatively high pulse frequency for each particular light component in conjunction with a relatively high clock frequency with short pulse duration by the serially operating light-emitting diodes 74,75,76 enables a corresponding high relative traveling speed between the sensing head 8 and the surface of the cop tube to be achieved. By way of example, if the color of a textile bobbin is to be sensed optically and electronically in a one-second cycle at a sensing time of 0.5 seconds per cop, a relative speed of at least 36 meters per minute must be accommodated. Advantageously, the sensing apparatus of the present invention is capable of reliably performing the described optical recognition methodology even at such high speeds of movement of the sensing head.

It is preferred that the processing and evaluating arrangements or devices within the central control unit 41 be provided with a buffer memory so that the serially received signals can be evaluated isochronously and, optionally, can also be displayed.

It is thereby possible to permanently store in the central control unit 41 typical color deviations, even for yarn windings, either relative to one or several color components or channels, in order to enable identification of even individual residual yarns. As will be understood, the diameter of frequently processed yarns is typically so small that the focal spot on the surface of a cop tube will be larger than an individual yarn diameter, so that light will be backscattered by the yarn itself but also by the tube at the same time, possibly including reflection of light rays passing through the yarn to the underlying surface of the tube. In such instances, the sensing apparatus must be capable of detecting even small deviations in the backscattered light from that produced by reflection by the tube surface alone. For this purpose, it must be determined and known in advance which deviations in the spectral color components are typical for an individual yarn winding, since such deviation will amount to only a fraction of the deviation which would be produced by a compact series of yarn windings.

The present apparatus is further effective to minimize to a large extent any influence on the sensing operation produced by contaminants or damaged areas on the tube. Basically, a sensing operation utilizing only one color channel or component can possibly suffice as a deciding criterion. It is frequently the case that the color components of the colors red and green may be very similar in cop tubes and yarn, so that it may be advantageous to select the color blue to best facilitate distinguishing between the tube and yarn windings if only a single color component is to be utilized.

The photooptic detector 61 is preferably capable of operating as a self-learning color sensor which can separately sense and store selectable primary colors, i.e., in the sense that the detector is adjustable to a particular color so as to be thereafter capable of comparing the color of other objects, such as cop tubes and yarn windings, with the selected color value. A so-called window discriminator, such as various electronic components having amplifier functions, may be utilized for evaluating the color signals for each selectable color. In addition, a summing device can be provided for forming a color sum signal representing a gray value for use in distinguishing an identification feature for the gray value. Electrical resistors which connect signal leads together and, in turn, connect them to an amplifier or difference amplifier are known for forming sums of various signals.

As aforementioned with respect to FIG. 5, the optical axis of the transmitter and receiver lenses 26,27 lie in a common horizontal plane, as shown in such drawing. As is known, conventional cop tubes may often be formed with circumferential concentric grooves in the outer periphery of the tubes, as represented by the grooves 3' in the tube 3 illustrated in FIG. 5, which also lie in a horizontal plane when the cop tube is positioned at the sensing station. However, the alternatingly concave and convex or flat surface contours in the outer periphery of the tube 3 do not have a negative influence on the operation of the present sensing apparatus, especially since the present invention relies on only a portion of the light rays from the transmitter lens being reflected through the receiver lens. Further, the arrangement of the optical axes of the transmitter and receiver lenses 26,27 in a horizontal plane normally also provides reliable sensing results even with cop tubes having a helical peripheral groove if the helix angle of the groove is not too large.

As will also be understood from FIG. 7, the light receiving arrangement, particularly the receiver lens 27 and the associated photooptic detector 61, may advantageously be mounted for selective positional movement vertically within an elongated opening 84, by which the plane intersecting the two optical axes of the transmitter and receiver lenses 26,27 can be selectively inclined with respect to horizontal. This adjustment can be particularly advantageous when the present sensing apparatus is utilized for processing cop tubes formed with a helical peripheral groove, such as represented by the tube 85 and its groove 85' shown in FIG. 7. In such case, it is preferred to arrange the transmitter and receiver lenses 26,27, as shown, with their optical axes inclined to horizontal by an amount equivalent to the helix angle of the groove 85', as represented by the angle $\delta$ in FIG. 7. This adjustment minimizes any deleterious influence by the groove 85' on the desired reflection of light off the surface of the tube 85. Such an adjustment may be necessary to achieve optimal sensing results if the helix angle of the groove 85' is too large.

As also seen in FIG. 7, the transmitter lens 26 is anchored in the housing of the sensing head 8 by means of a fixed holder, indicated representatively at 73. However, it is also contemplated to be possible that the holder may be arranged to permit a selective adjustment of the lens 26 lengthwise along its optical axis, e.g., by providing the holder with screw threads. Such an adjustment enables the focal point of the transmitter lens 26 to be adjusted toward and away from the position occupied by a cop or tube at the sensing station, which can be necessary or advantageous to precisely adjust the sensing precision of the apparatus. For example, as aforementioned, it may be desired in certain embodiments or applications that the focal point of the transmitter lens be located in front of the peripheral surface of the textile tube, which could be selectively accommodated by the described adjustment.

It will be recognized that, in instances in which the beginning and end of residual yarn is sensed on a cop tube over a relatively significant extent of the length of the tube, the conclusion could be drawn that a relatively large amount of residual yarn remains on the tube, which of course would be reusable and thereby suitable for return to the winding machine, or alternatively the residual yarn may be small in amount and have become drawn or spread over a significant length of the tube, in which case the residual yarn would not be sufficient to warrant return of the tube to the winding machine. It is contemplated to be possible in the sensing operation of the present apparatus to evaluate and make determinations as between these possibilities in such circumstances, for example, by appropriate programming of the central control unit 41 to recognize gaps, spaces or other discontinuities in the residual yarn as the sensing head 8 moves along the tube, whereby tubes having non-reusable amounts of residual yarn are not mistakenly returned to the winding machine.

As previously mentioned, the apparatus of the present invention permits the sensing head 8 to be reciprocated in an alternating manner to perform sensing operations both while traveling downwardly from top to bottom along a cop at the sensing station and also while traveling upwardly from bottom to top along a cop at the sensing station. The provision of the Hall sensors 43,44 enables the apparatus in each case to recognize the particular direction of movement of the sensing head 8 and, correspondingly, to determine the particular position of residual yarn on each cop, independently of the direction in which the sensing head is moving during any particular sensing operation. The provision of both upper and lower stop members 22,31 is additionally beneficial to this form of operation, since the sensing head 8 will be alternately located at its uppermost and lowermost extreme positions as tubes or cops are supplied in sequence to the sensing station, whereby the stop members 22,31 serve to prevent potentially damaging contact between the sensing head 8 and the cops or tubes.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for recognizing the presence of residual yarn on a textile bobbin comprising a device for optically sensing yarn and means for moving one of the sensing device and the textile bobbin relative to the other longitudinally with respect to the axis of the textile bobbin, said sensing device comprising a light transmitter for generating a limited beam of light rays, a transmitter lens for focusing the light rays onto the surface of the textile bobbin, and a photooptic detector having a receiver lens for receiving the light rays reflected off the surface of the textile bobbin, said transmitter lens and said receiver lens having respective optical axes which, during relative movement between said sensing device and said textile bobbin: (a) intersect one another in the area of the surface of the textile bobbin, (b) are oriented relative to the textile bobbin such that a line bisecting said optical axes deviates from a line which is perpendicular to the surface of the bobbin and which intersects the point of intersection of the optical axes by an angle of deviation of at least about ten degrees (10°), and (c) lie in a common plane oriented at an angle of at least about ninety degrees (90°) relative to a line representing the path of relative movement of the focused light rays from said transmitter lens longitudinally along the surface of the textile bobbin.

2. Apparatus for recognizing the presence of residual yarn on a textile bobbin according to claim 1 wherein the surface of the textile bobbin is formed with a helical groove oriented at an angle $\delta$ relative to the axis of the textile bobbin and wherein said angle of said common plane of said optical axes to said line of relative movement of said focused light rays along said textile bobbin is substantially equal to ninety degrees (90°) plus $\delta$.

3. Apparatus for recognizing the presence of residual yarn on a textile bobbin according to claim 1 wherein the angle between said optical axes of said transmitter and receiver lenses is greater than the sum of the maximum focal angle of said transmitter lens measured between its optical axis and the path of focused light rays passing through its outermost edge and the maximum focal angle of said receiver lens measured between its optical axis and the path of focused light rays passing through its outermost edge.

4. Apparatus for recognizing the presence of residual yarn on a textile bobbin according to claim 1 and further comprising means for positioning the textile bobbin relative to said sensing device and wherein said moving means comprises means for supporting said sensing device for selective movement lengthwise of the textile bobbin at a uniform spacing therefrom.

5. Apparatus for recognizing the presence of residual yarn on a textile bobbin according to claim 1 wherein said supporting means comprises means for biasing said sensing device toward the textile bobbin for maintaining a predetermined spacing between said transmitter and receiver lenses and the textile bobbin and wherein said sensing device comprises an engagement surface for contact with residual yarn on the textile bobbin to deflect said sensing device away from the textile bobbin against said biasing means.

6. Apparatus for recognizing the presence of residual yarn on a textile bobbin according to claim 1 wherein said transmitter lens comprises a focusing lens having a focal length no greater than its spacing from the surface of the textile bobbin.

7. Apparatus for recognizing the presence of residual yarn on a textile bobbin according to claim 6 wherein said optical axis of said transmitter lens is directed perpendicularly to the surface of the textile bobbin.

8. Apparatus for recognizing the presence of residual yarn on a textile bobbin according to claim 1 wherein said light transmitter comprises a plurality of light-emitting diodes which respectively radiate light rays in differing spectral ranges and are arranged relative to said transmitting lens to direct their respective light rays onto a common focal point, and means for controlling said diodes to emit their respective light rays in serial pulses.

9. Apparatus for recognizing the presence of residual yarn on a textile bobbin according to claim 4 and further comprising means associated with said supporting means for determining the position of said sensing device along the textile bobbin.

10. Apparatus for recognizing the presence of residual yarn on a textile bobbin according to claim 9 wherein said supporting means comprises a carriage carrying said sensing device, guide means supporting said carriage for reciprocal movement therealong, and drive means for driving reciprocal movement of said carriage, and said position determining means comprises means for generating pulses in relation to movement of said carriage and means for counting said pulses.

11. Apparatus for recognizing the presence of residual yarn on a textile bobbin according to claim 10 wherein said position determining means comprises a sensor for detecting the presence of said carriage in a starting position thereof and associated with said pulse counting means for resetting thereof to a zero starting value.

12. Apparatus for recognizing the presence of residual yarn on a textile bobbin according to claim 11 wherein said driving means is arranged for reciprocating movement of said carriage alternatingly between said starting position and a predetermined maximum moved position.

13. Apparatus for recognizing the presence of residual yarn on a textile bobbin according to claim 4 wherein said bobbin positioning means comprises centering means for engaging the textile bobbin to maintain its surface facing said sensing device substantially parallel to the path of movement of said sensing device relative to the textile bobbin.

* * * * *